US007891574B1

(12) United States Patent
Kennedy et al.

(10) Patent No.: US 7,891,574 B1
(45) Date of Patent: Feb. 22, 2011

(54) DIFFERENTIAL TEMPERATURE DISPLAY SYSTEM

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 1661 days.

(21) Appl. No.: 11/099,089

(22) Filed: Apr. 5, 2005

(51) Int. Cl.
*G05D 23/00* (2006.01)

(52) U.S. Cl. ..... 236/91 F; 236/91 C; 236/94; 62/127

(58) Field of Classification Search ..... 236/91 F, 236/91 C, 91 E; 62/127
See application file for complete search history.

(56) References Cited

U.S. PATENT DOCUMENTS 4,363,441 A * 12/1982 Feinberg ..... 236/36

OTHER PUBLICATIONS

ThomasNet Industrial Newsroom: http://web.archive.org/web/20041026034350/http://news.thomasnet.com/fullstory/453332.*

Mini TK52 Operating Instructions.*

"Differential Temperature Meter." Newport—Home Page Oct. 3, 2003. Web. Jul. 12, 2010. <http://www.newportus.com/PDF/INFCDR.pdf>.*

Fox & Co., Balancing a Central Heating System web page, http://www.muswell-hill.com/foxandco/pages/balancing.htm, 3 pages, admitted prior art.

* cited by examiner

*Primary Examiner*—Cheryl J Tyler
*Assistant Examiner*—Jonathan Bradford
(74) *Attorney, Agent, or Firm*—Senniger Powers LLP

(57) ABSTRACT

A differential temperature display system for balancing hydronic systems includes a first sensor for sensing a supply temperature and for outputting a first signal indicating the supply temperature. A second sensor is adapted for sensing a return temperature and for outputting a second signal indicating the return temperature. At least one integrated circuit is adapted for calculating a differential between the supply and return temperature. A single electronic display is adapted for displaying one of the supply temperature and the differential. A method of using the system is also disclosed.

15 Claims, 3 Drawing Sheets

DIFFERENTIAL TEMPERATURE DISPLAY SYSTEM

BACKGROUND OF THE INVENTION

The present invention relates generally to temperature displays, and more particularly to differential temperature display systems for balancing hydronic systems.

Fluid flow in complex hydronic (heating or cooling) systems, like those typically used in large buildings or groups of buildings, needs to be balanced. The goal in balancing the hydronic system water flow is to have a desired temperature change across each heating or cooling unit (fan coil, radiator, heater, hydronic chiller, etc.), consistent with the lowest total pumping resistance. It is practically impossible to predict a balanced flow prior to actual operation in hydronic systems using parallel flow to units.

Hydronic systems use "balance valves," which are valves installed at each of the heating and cooling units that can be partially closed to increase the resistance to flow through that unit. To balance a system, a technician will measure the temperature differential across each unit and adjust the balance valve, i.e., restrict fluid flow, until a desired temperature drop is achieved.

One problem is that the technician using a standard differential thermometer only monitors temperature differential, and he does not monitor supply fluid temperature to ensure that fluid flowing through the unit (supply fluid) is at full temperature. For example, there could be a low temperature drop across the unit because there was too little supply fluid flowing to the unit. Also, the temperature display on standard hand-held meters cannot be read from a substantial distance, which makes it more difficult for the technician to read the temperature while balancing the hydronic system. Thus, a simple, easy-to-use and easy-to-read differential thermometer that also prominently displays supply temperature is needed.

SUMMARY OF THE INVENTION

Briefly, one aspect of this invention is directed to a differential temperature display system for balancing hydronic systems. The display system comprises a first sensor for sensing a supply temperature and for outputting a first signal indicating the supply temperature. A second sensor is adapted for sensing a return temperature and for outputting a second signal indicating the return temperature. At least one integrated circuit is adapted for calculating a differential between the supply and return temperature. A single electronic display is adapted for displaying one of the supply temperature and the differential. The at least one integrated circuit is configured to automatically toggle the display between displaying the supply temperature and the differential. Also, the toggling occurs at a predetermined interval.

In another aspect, the display has a height of at least about 0.25 inches so as to be visible from a distance of at least about 3 feet. In this aspect, the display need not necessarily toggle automatically.

In still another aspect, a method of balancing a hydronic system uses the temperature display system and comprises placing the first sensor in contact with the supply line and placing the second sensor in contact with the return line. The method further includes adjusting a balance valve based on the displayed supply temperature and displayed differential.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
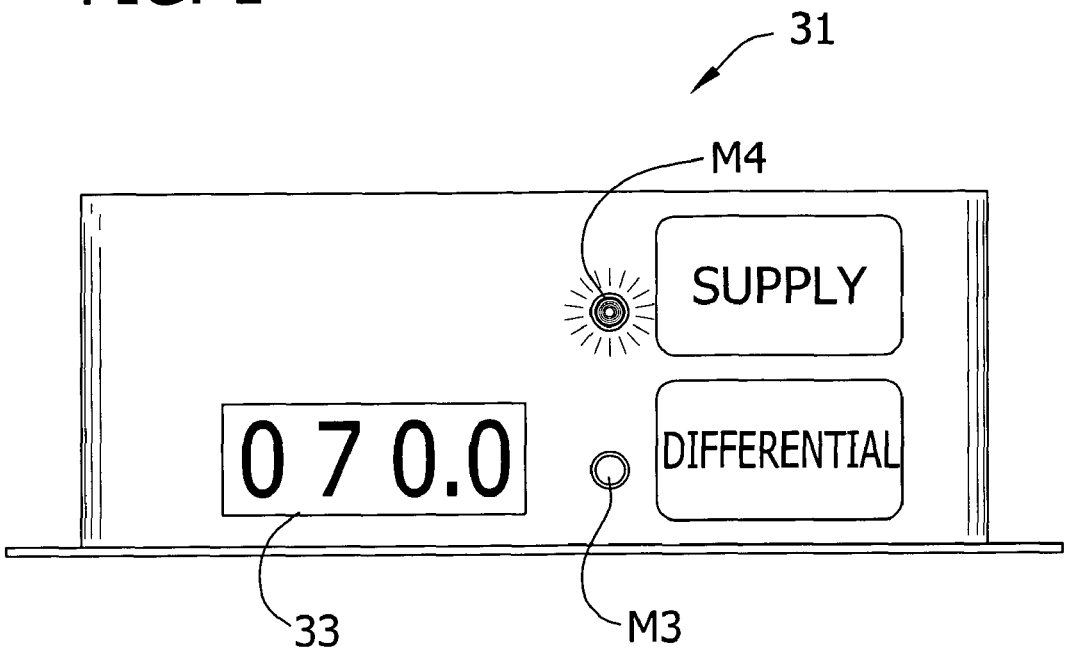
FIG. 1 is a front view of a differential temperature display system.

Referring now to the drawings and in particular to FIG. 1, a differential temperature display system of an embodiment of the present invention comprises a display unit designated in its entirety by the reference numeral 31. The unit 31 includes a single electronic display 33. The display toggles between displaying a supply temperature and a differential between supply and return temperatures, as indicated by the indicator M4 adjacent the label "SUPPLY" and the indicator M3 adjacent the label "DIFFERENTIAL". The display unit 1 of this embodiment is not designed for displaying data other than the supply temperature and the differential.

Figure 2A:
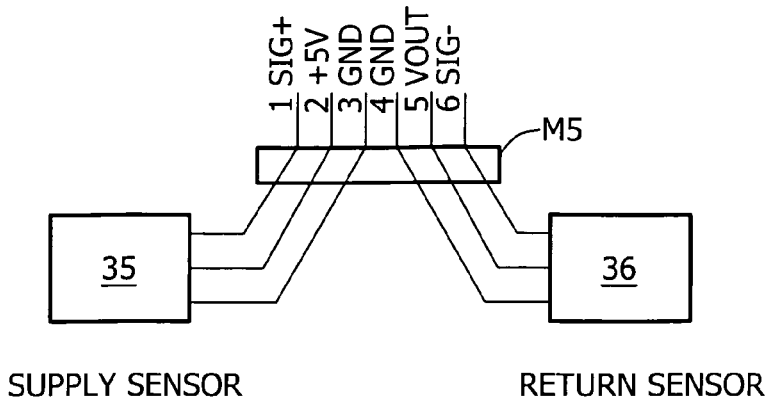
FIG. 2A is a schematic of sensor circuits.
Figure 2C:
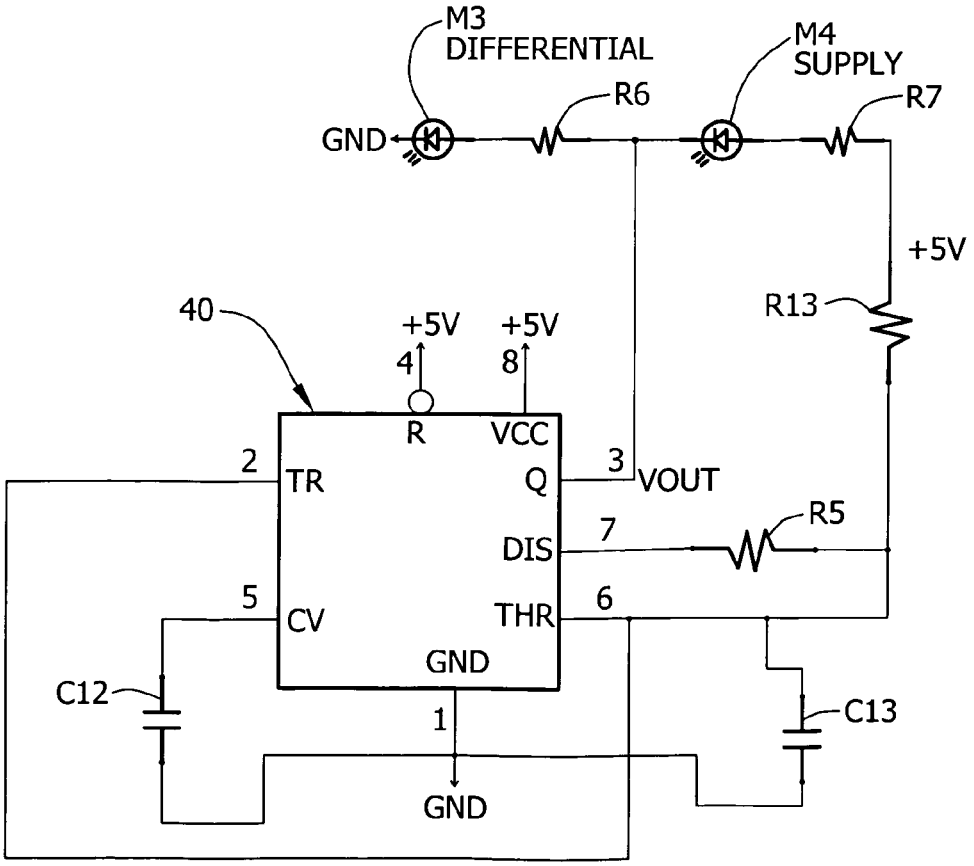
FIG. 2C is a schematic of an alternate display circuit.
Figure 2B:
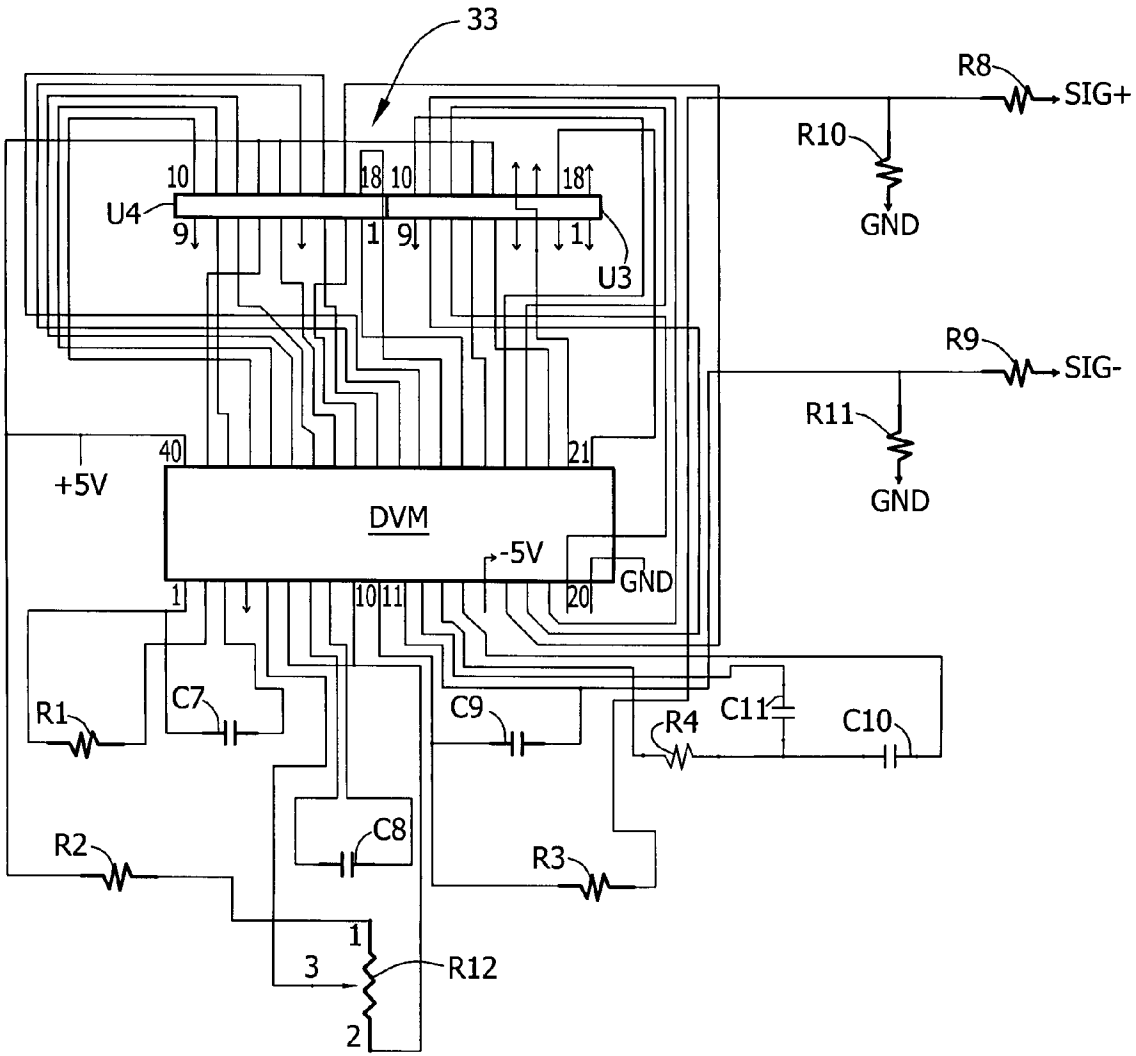
FIG. 2B is a schematic of a digital volt meter and display driver.

As shown in FIGS. 2A-2C, the circuit has three main sections or circuits. FIG. 2A shows the sensor section. The temperatures are sensed by two temperature sensor chips that output the temperature linearly at 10 millivolts per degree. A supply sensor chip 35 outputs a signal "sig+" at a predetermined value (e.g., 10 millivolts per degree) indicating the supply temperature. The signal is received to the DVM/display section (FIG. 2B). A return sensor chip 36 outputs a signal "sig−" indicating the return temperature. The chips 35, 36 are connected to a terminal strip M5 as shown in FIG. 2A.

FIG. 2B shows the digital volt meter/driver chip (DVM) (broadly, integrated circuit) and the display 33. In one embodiment, the DVM is a JK-U4001 chip available from Jack Kennedy Metal Products & Buildings, Inc., Taylorville, Ill. (hereinafter, JK numbers refer to products available from Jack Kennedy Metal Products). The display 33 includes two JK-M0003 LED numeric display elements. The display is at least 0.25 inches high so that the display is visible from a distance of at least 3 feet, and more suitably at least 0.75 inches so as to be visible from 15 feet.

Signals input to the DVM are displayed as though they were a voltage. Because the sensors 35, 36 output a voltage that is proportional to the temperature in degrees F., the display can be configured and arranged to display degrees F. with a conventional voltage divider (e.g., R8 and R10). The supply sensor output enters the DVM via pin 10, and the return sensor output enters via pin 11.

FIG. 2C shows the third section, the toggling or alternating display. The display includes an integrated circuit or chip 40, such as a model JK-U0003 chip, with output VOUT at pin 3. The chip alternately sinks and sources to change pin 3 from a low to a high state at the desired display change rate. When pin 3 of chip 40 is at its low state, the supply indicator M4 lights (the indicator is connected to the +5 V). Also, the return sensor is not functioning at the low state because pin 5 (VOUT) on terminal strip M5 is also low (it is effectively ground on pins 4 and 5). Note that pin 5 of the strip M5 is also connected to pin 3 of the chip 40. At this time, the DVM is only receiving a signal from the supply sensor 35, and thus the supply temperature is displayed. But when the pin 3 and chip 40 change to the high state, the supply indicator M4 will turn off (because it now has the same potential, +5V, on both sides), the differential indicator M3 will light and the return sensor receives power and starts working.

Referring to FIGS. 2B and 2C, the signal from the return sensor 36 is connected to pin 11 of the DVM through another voltage divider (R9 and R11), similar to that of the supply sensor 35. When the DVM receives the two signals, it algebraically sums them, and the differential is shown by the display 33.

Other components are mostly conventional "setup" requirements for the chips, but with three exceptions. First, R12 is a zero set point used to set the DVM to zero volts, which ensures the display 33 will show 0.0 when in the differential mode and when both sensors 35, 36 are at the same temperature. Secondly, R4, C10, and C11 are an RC oscillator for the clock in the DVM. And third, R5 and C13 are the time constant components on the chip that determine the change rate between the supply temperature and the differential temperature. Varying the respective resistance and/or capacitance of the time constant components will vary the change rate. Note that the configuration can be modified to make the rate programmable by the user. The change rate is chosen to be long enough so that the technician has time to read the number, but so that he/she does not have to wait for an extended period to see the other number. The change rate is suitably between 1 and 8 seconds. The configuration can also be chosen so that the differential is displayed for a longer time period than the supply temperature, or vice versa.

The power supply is not shown, but is suitably 5 volts, and may be derived from the primary of either 115 or 230 volts AC. Thus, the display unit 1 can be wired directly to a heater's fan motor, water valve, etc., if desired.

As an example, the following chart shows the part numbers for the various components in FIGS. 2A-2C:

| Part Designation | Part Number |
|---|---|
| C7 | JK-C0412 |
| C8 | JK-C0513 |
| C9 | JK-C0501 |
| C10 | JK-C0517 |
| C11 | JK-C0521 |
| C12 | JK-C0501 |
| C13 | JK-C0525 |
| M3 | JK-M0002 |
| M4 | JK-M0002 |
| M5 | JK-M3003 |
| R1 | JK-R0121 |
| R2 | JK-R0105 |
| R3 | JK-R0145 |
| R4 | JK-R0113 |
| R5 | JK-R0162 |
| R6 | JK-R0060 |
| R7 | JK-R0060 |
| R8 | JK-R2314 |
| R9 | JK-R2314 |
| R10 | JK-R2122 |
| R11 | JK-R2122 |
| R12 | JK-M7001 |
| R13 | JK-R0169 |

As should be apparent, the above configuration is merely one example of the invention, and other embodiments are contemplated within the scope of the invention. For example, other types of sensors, displays and chips may be used within the scope of the invention.

In one alternative embodiment, the display unit 1 displays the highest temperature encountered over a given time period by one or both of the supply and return sensors 35, 36. The highest temperature can be displayed on the single display 33 shown in FIG. 1, or on separate displays. A "high temp." feature would be helpful where the system is permanently installed, especially at a steam trap, where a technician can periodically check the high temperatures reached. For example if the return temperature reaches a high that is very near the supply temperature, then this would indicate a steam trap malfunction. This embodiment can include a reset button to reset the system after the high temperatures are checked/registered by the technician.

Example Methods

Hydronic systems use balance valves to increase the resistance to flow through particular units. In practice, nearly all the balance valves are partially closed. Typically, only the units at the most extreme flow resistance points would be wide open.

Generally, a technician will provide power to the display unit 1, attach the sensors 35, 36 to the respective supply and return lines of a given unit (e.g., a heater), and read the supply and differential temperatures. If the differential is low (e.g., 2 degrees), the technician next sees the supply temperature (within a matter of seconds) and can thereby ensure that there is flow through the supply line before he tries to balance the flow. The technician can then adjust the appropriate valve while simultaneously viewing the supply temperature and differential.

In more detail, the difficulty encountered in balancing a hydronic system is two-fold. First, the balance valves that are at the lowest resistance points must be closed to force the water to the extremes of the system. Balancing can only be properly done if the water temperature drop across the heating unit is known. As an example, a typical hot water system is designed for a 20 degree drop across each heating unit. Heating units nearer to the pump or with less restrictive piping may have, for example, only a 2 degree drop when their balance valve is wide open. By watching the differential thermometer display unit 1, a technician can close the valve until water flow is restricted such that a 20 degree drop is achieved in the water flowing through that unit. Next the technician goes to the heating unit that had the next lowest temperature drop and partially closes its balance valve. Note that in each case the act of closing the valve has the effect of both increasing pumping resistance and creating more flow everywhere else in the system, including in the units already balanced. Hence all of the heating units except the last will have to be repeatedly readjusted to maintain the desired drop.

The skillful technician will monitor the "last unit", i.e., the heating unit that shows the highest drop with its balance valve wide open. When that unit gets sufficient water to get its drop down to the desired 20 degrees, the system is balanced. Closing valves thereafter will only increase pump pressure and thereby make the system less efficient. Note the "last unit" may not be the unit furthest from the pump, but may rather be quite close to it physically if that unit's piping or the unit itself has particularly high resistance. Therefore the term "last unit" in this case refers to the heating unit where the combined piping resistance and the unit resistance is the highest, and does not necessarily mean the unit that is the furthest physical distance from the pump.

Another use of the invention involves areas of excess heating capacity in the system. If a given area does not have enough heat, for example, one could open that area's heating unit valves slightly to create a 10 degree drop, rather than a 20 degree drop. This reduced drop causes a doubling of the output of that heater, and with careful examination of the other heating units outside the given area, one can decide what, if anything, needs to be done regarding the overall system balance. For example, it might be possible to simply rebalance the system by closing, at least partially, a valve in another area where there is excess heating capacity.

But there is another problem. When the technician first started closing the valve on the heating unit that had the least drop, he could have been making a mistake. Note that the unit physically nearest the pump may not have been the one that was really in the least resistance path. In fact, it could have been showing a low temperature drop because it was getting little or no water. A simple differential thermometer without a supply temperature indication would have led the technician astray. The display unit 1 of this invention will avoid this problem because the technician immediately and automatically sees the supply temperature.

Before a balance valve is adjusted, the technician must know that full temperature water is entering the heating unit. This is accomplished by using a display unit 1 of the invention. If higher water temperatures are found in another location, the low temperature heating unit should be located at that location, not where the supply temperature is low. Hence the alternating temperature display of both the fluid temperature and the temperature drop across a given heating unit is advantageous.

The embodiments described here are typical for use with a heating system using water. Embodiments can also be used for steam traps, cooling systems, and for heating/cooling systems that use steam, water-alcohol or water-glycol mixtures, fluorocarbon refrigerants, $CO_2$, ammonia, or other media. The temperature sensors can sense the heat carrying medium within the system, or the heated (or cooled) environment itself, e.g., the outside air heated or cooled using the system. Also, embodiments of the invention are useful for all types of hydronic systems, but especially those that use parallel flow to units. Moreover, a display unit of the invention can be permanently installed at one heating unit or at all heating units in a system, and can be configured to interface with a computer, e.g., to send data to a remote location for off-site monitoring.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A differential temperature display system for balancing an hydronic system comprising heating or cooling units, said differential temperature display system comprising a display unit, said display unit comprising:

a first sensor for sensing a supply temperature of the hydronic system and for outputting a first signal indicating a supply temperature, a second sensor for sensing a return temperature of the hydronic system and for outputting a second signal indicating a return temperature, at least one circuit for calculating a differential between the supply and return temperatures of the hydronic system, a single electronic display for displaying one of the supply temperature and the differential, the at least one circuit configured to automatically toggle the display between displaying the supply temperature and the differential, and further configured to toggle the display at a predetermined interval to facilitate balancing the hydronic system, and the display unit includes only two temperature sensors.

2. The differential display system of claim 1 wherein the display is at least 0.75 inches tall so as to be visible from a distance of at least about 15 feet.

3. The differential display system of claim 1 wherein the predetermined interval is between 1 and 8 seconds.

4. The differential display system of claim 3 wherein the predetermined interval is such that one of the supply temperature and the differential is displayed for a longer time period than the other of the supply temperature and the differential.

5. The differential display system of claim 1 wherein the display unit includes at least two integrated circuits including a first integrated circuit for calculating the differential and a second integrated circuit for toggling the display.

6. The differential display system of claim 1 wherein the display unit is capable of displaying only the supply temperature and the differential.

7. The differential display system of claim 1 wherein the display unit is programmed for displaying a high temperature sensed by at least one of the sensors.

8. A differential temperature display system for balancing an hydronic system comprising heating or cooling units, said differential temperature display system comprising a display unit, said display unit comprising:

a first sensor for sensing a supply temperature of the hydronic system and for outputting a first signal indicating the supply temperature, a second sensor for sensing a return temperature of the hydronic system and for outputting a second signal indicating the return temperature, at least one integrated circuit for calculating a differential between the supply and return temperatures of the hydronic system, a single electronic display for displaying one of the supply temperature and the differential, wherein the display has a height of at least about 0.25 inches tall so as to be visible from a distance of at least about 3 feet, and wherein the display unit includes only two temperature sensors and the single display is only capable of displaying the supply temperature and the differential, the display unit being incapable of displaying other data to facilitate balancing the hydronic system.

9. The differential display system of claim 8 wherein the display has a height of at least about 0.75 inches tall so as to be visible from a distance of at least about 15 feet.

10. The differential display system of claim 8 wherein the display consists of light-emitting diodes.

11. The differential display system of claim 1, further comprising a plurality of said display units installed on a plurality of heating units of said hydronic system.

12. The differential display system of claim 11, comprising a plurality of said display units interfacing with a computer.

13. The differential display system of claim 1, wherein each display unit further comprises a first visual indicator for indicating when the display is displaying the supply temperature and a second visual indicator for indicating when the display is displaying the differential.

14. The differential display system of claim 13, wherein said first visual indicator is a first light which illuminates when the supply temperature is displayed and the second visual indicator is a second light which illuminates when the differential is displayed.

15. The differential display system of claim 13, wherein said first visual indicator includes a supply temperature label adjacent the first light, and said second visual indicator includes a differential label adjacent the second light.

* * * * *